US008479516B2

(12) United States Patent
Carter

(10) Patent No.: US 8,479,516 B2
(45) **Date of Patent: *Jul. 9, 2013**

(54) CLOSED LOOP SCROLL EXPANDER

(75) Inventor: Preston Henry Carter, Bend, OR (US)

(73) Assignee: SECCO2 Engines Inc., Pleasanton, CA (US)

( * ) Notice: Subject to any disclaimer, the term of this patent is extended or adjusted under 35 U.S.C. 154(b) by 167 days.

This patent is subject to a terminal disclaimer.

(21) Appl. No.: 13/180,212

(22) Filed: Jul. 11, 2011

(65) Prior Publication Data

US 2011/0259009 A1 Oct. 27, 2011

Related U.S. Application Data

(63) Continuation of application No. 12/283,060, filed on Sep. 8, 2008, now Pat. No. 8,006,496.

(51) Int. Cl.
*F01K 7/34* (2006.01)

(52) U.S. Cl.
USPC ..... 60/653; 60/660; 60/677; 60/679

(58) Field of Classification Search
USPC ..... 60/653, 677–680, 660
See application file for complete search history.

(56) References Cited

U.S. PATENT DOCUMENTS

| | | | |
|---|---|---|---|
| 801,182 | A | 10/1905 | Creux |
| 2,231,440 | A | 2/1941 | Fess |
| 3,237,403 | A | 3/1966 | Feher |
| 3,391,062 | A | 7/1968 | Tidball |
| 3,972,195 | A | 8/1976 | Hays |
| 4,129,405 | A | 12/1978 | McCullough |
| 4,157,234 | A | 6/1979 | Weaver |
| 4,199,308 | A | 4/1980 | McCullough |
| 4,211,207 | A | 7/1980 | Molivadas |
| 4,344,849 | A | 8/1982 | Grasso |
| 4,477,239 | A | 10/1984 | Yoshii |
| 4,490,099 | A | 12/1984 | Terauchi |
| 4,497,615 | A | 2/1985 | Griffith |
| 4,505,651 | A | 3/1985 | Terauchi |
| 4,677,949 | A | 7/1987 | Youtie |
| 4,773,144 | A | 9/1988 | Youtie |
| 4,824,343 | A | 4/1989 | Nakamura |
| 4,824,345 | A | 4/1989 | Fukuhara |
| 4,864,826 | A | 9/1989 | Lagow |
| 4,927,339 | A | 5/1990 | Riffe |
| 4,990,071 | A | 2/1991 | Sugimoto |
| 5,094,205 | A | 3/1992 | Billheimer |
| 5,247,795 | A | 9/1993 | McCullough |
| 5,293,850 | A | 3/1994 | Nishida |
| 6,220,840 | B1 | 4/2001 | Calhou |
| 6,263,664 | B1 | 7/2001 | Tanigawa |

(Continued)

FOREIGN PATENT DOCUMENTS

| | | | |
|---|---|---|---|
| WO | WO9524822 | A2 | 9/1995 |
| WO | WO2008125827 | A3 | 10/2008 |

*Primary Examiner* — Hoang Nguyen
(74) *Attorney, Agent, or Firm* — Schwabe Williamson & Wyatt

(57) ABSTRACT

Apparatuses and methods related to an engine for converting heat into mechanical output using a working fluid in a closed circulating system are disclosed. In some embodiments, the engine includes a pump to pressurize the working fluid, a regenerative heat exchanger to transfer heat from a first portion of the working fluid to a second portion, a heating device to heat the working fluid, and a scroll expander to expand the working fluid and generate the mechanical output. Other embodiments may be described and claimed.

15 Claims, 10 Drawing Sheets

U.S. PATENT DOCUMENTS

| | | | | |
|---|---|---|---|---|
| 7,124,585 | B2 | 10/2006 | Kim | |
| 7,284,363 | B2 | 10/2007 | Kung | |
| 7,428,816 | B2 | 9/2008 | Singh | |
| 8,006,496 | B2 * | 8/2011 | Carter | 60/653 |
| 2002/0148225 | A1 | 10/2002 | Lewis | |
| 2003/0000213 | A1 | 1/2003 | Christensen | |
| 2004/0255591 | A1 | 12/2004 | Hisanag | |
| 2006/0213218 | A1 | 9/2006 | Uno | |
| 2007/0199323 | A1 | 8/2007 | Yamaguchi | |
| 2009/0022613 | A1 | 1/2009 | Dai | |

* cited by examiner

CLOSED LOOP SCROLL EXPANDER

CROSS REFERENCE TO RELATED APPLICATION

This application is a continuation of U.S. application Ser. No. 12/283,060, entitled "Closed Loop Scroll Expander," filed 8 Sep. 2008, the specification of which is hereby fully incorporated by reference.

BACKGROUND OF THE INVENTION

The present invention generally relates to the methods and devices for high efficient power conversion by means of an externally heated closed loop regenerative heat engine which utilizes high pressure fluid, preferably carbon dioxide, through at least one scroll expander for the co-generation of shaft power, fluid power or refrigeration.

Currently the state of the art for engines are dominated by internal combustion engines based upon open-loop Otto cycle, Diesel cycle, or Brayton thermodynamic power cycles. Engines based upon these cycles have proven to be sufficiently efficient for many applications and the current state of the art including the benefits and detriments of the various types of engines is discussed in light of the present invention and the objectives of the present invention.

Otto Cycle and Diesel Cycle engines are used primarily for application in automobile, airplanes and other low cost applications (lawn mowers, pumps, etc. . . . ). These types of engines (two and four stroke engines) are efficient, lightweight, and fairly inexpensive to manufacture. Generally, in the last eighty years there has been much more focus in improving the designs and efficiencies for these types of engines by the various industries needing a cheap efficient means for converting power. There are significant limitations associated with using these types of internal combustion engines, including: a efficiencies of approximately 20% to 30%; a limited type of fuel associated with each type of engine; serious vibration and noise associated with cams, camshafts and piston rods; power density limitations; significant green house and carbon fuel emission associated with internal combustion engines; and limitations associated with operations of an internal combustion engine at limited air density environments (Brayton cycle turbines have this limitation as well).

In an internal combustion engine, the working fluid is primarily air. Heat through combustion is created by injecting and burning fuel with the working fluid at the proper location and at the proper time in the engine's cycle. This enables the working fluid to be expanded, which in part, produces work. While these engines are well understood and well developed, it is also known that these engines produce much less power than their theoretical limits due to the limitations association with the friction, heat loss and the timing associated with the combustion of the fuel and air mixture within the cylinder of an engine block.

These limitations can also limit the ability to control the quality of combustion and the range of air to fuel mixtures that can be ignited. The level of power available from these types of engines (Otto and Diesel cycle engines) is proportional to the mass flow of air passing through the engine itself. It is well known that these engines decrease delivered power as the atmospheric density of air decreases with altitude and the air temperature increases because the net mass flow of air available to the engine decreases.

In many applications, engines must operate in an environment with reduced atmospheric density. There is a decrease of power availability due to atmospheric density that is noted by the prior art and addressed in U.S. Pat. No. 7,284,363 which discloses a means for power generation for airborne vehicles operating at an altitude of 50,000 feet (above sea level). The various descriptions, in the '363, for closed loop engines converting power are limited to generic claims utilizing a Brayton or Rankine cycle type engine. The description of the working fluid expansion in the closed loop is done by means of a turbine, in both the Brayton and Rankine cycle mode of operation.

The present invention provides an engine that is capable of operating in a variety of thermodynamic cycle modes, including; Rankine, Brayton, or a supercritical cycle similar to U.S. Pat. No. 3,237,403 discussed below. The mode of operation is dependent on several factors, including: the environment in which the engine is operating; the type of working fluid used in the engine; the type of heat source utilized; and manipulation of the working fluid's temperature and pressure. The present invention takes advantage of the close loop system and is not limited to applications less than 50,000 feet. Additionally, the present invention provides a means for accomplishing power conversion in a small lightweight package with a high power density that can be utilized in numerous environments.

It is one objective of the present invention to be able to operate as a closed loop Rankine thermodynamic cycle for maximum efficiency and, depending on the conditions in which the engine is operating and the type of heat source used by the engine, be able to operate in other thermodynamic modes, like a Brayton cycle. Heat supplied to the working fluid is provided external to the engine and is transferred to the working fluid through means of a heat exchanger, such as an evaporator or boiler, thereby eliminating inefficiencies associated with integrating heat addition within the engine.

Generally the heat source will be something that is created through combustion of fossil fuels. External combustion or heat addition is an excellent means for increasing the efficiency of power generation without compromising the method of the heat addition. External combustion also greatly reduces the amount and type of green house gasses and pollution emitted by the engine. One objective of the present invention is to provide an engine that is able to use a variety of fuels or heat sources.

There are several externally heated engines in the prior art that are based upon the Stirling, and Ericsson thermodynamic power cycles. These examples in the prior art follow both open-loop and closed-loop thermodynamic cycle. There are also a number of mechanical and fluidic embodiments of these cycles in the prior art. From a theoretical stand point both the Stirling and Ericsson cycles potentially achieve efficiency near the absolute limit, defined by the efficiency of a Carnot cycle; however, in actual practice these cycles require isothermal compression and expansion of the working fluid. The physical means for achieving an isothermal process in compression and expansion is bulky, involves friction losses, and is limited by the power rate that can be achieved with heat exchangers. This has proven to make these types of heat engines heavy for the power they produce and do not achieve their desired theoretical efficiency.

For example, U.S. Pat. No. 7,124,585 discloses a scroll type expander having an integrated heating surface for the exchange of thermal energy to work output as a means for power conversion in this Stirling cycle type engine. This particular invention, besides having the limitation described above, has limitations associated with capturing or exchanging thermal energy integrated with an engine bloc of the system. In creating this type of engine, which has high theoretical efficiency, there is in reality several impracticalities for producing a small, lightweight, high power engine as described in the present invention, such as size and power output limitations.

In the present invention, the heat source is provided independent of the engine block or work output means and therefore provides more flexibility for the design and power output of the engine. Additionally by divorcing the heat generation from the engine block or power producing portion of the engine, heat sources that use carbon fuel consumption can be greatly enhanced with respect to the efficiency associated with complete combustion, heat transfer of combusted fuels, increase in the type of fuel consumed and a cleaner more easily managed fuel exhaust. It is one of the objectives of the present invention to provide an engine that is flexible with respect to the types of fuels that will be used for combustion or the type of heat source used on a working fluid in the closed loop. Currently, governmental and societal demands have been trending toward a need for an engine that is flexible with respect to the type of fuel consumed or used by engines.

In one embodiment of the present invention, the engine operates using the well proven and understood Rankine cycle. By taking advantage of the phase change in the closed loop, its efficiency is comparable to that achievable by Stirling and Ericsson cycle engines, but its power capability is far higher because it is not limited by isothermal compression and expansion. A good description of the power efficiency associated with the present invention is found in U.S. Pat. No. 3,237,403 issued to Feher in 1966 which discloses a device and method for using a supercritical fluid in a heat engine. The patent discloses the benefits associated with an external engine operating in a Rankine cycle. The description of the closed loop system anticipates a turbine or possibly a piston engine for expanding the high temperature high pressure working fluid (Col. 2, line 2-5). The patent, while describing the benefits of using a supercritical working fluid at a low cycle pressure substantially above critical pressure and a temperature below critical temperature, still lacks detail on how to effectively accomplish this process for a high pressure high temperature working fluid in a relatively small, lightweight package. The means for expanding or the method for expanding the working fluid in the claims are not disclosed in any detail, other than anticipation or use of a turbine.

In addition to a generic description of the process and the benefits associated with operating an engine at prescribed temperatures and pressures, the '403 concedes the "various mechanical components of the system are quite conventional in type but the components must be specially designed and built to operate properly under special conditions such as pressure, pressure ratio, high density of fluid passing through the turbine, and temperature and pressure limits in the regenerator, evaporator, condenser, etc." The present invention addresses these limitations and actually describes in detail an engine that can operate in the mode described by the '403 as well as parameters beyond the scope of the '403.

In the detailed descriptions and claims of the '403, there was very little detail provided for the type of engine that was to be used in the application of the '403 patent. With the exception of calling for a "turbine", the prior art relating to this type of engine concept do not address the means for power conversion addressed by the present invention.

In a Rankine cycle, as in one embodiment of the present invention, the engine's working fluid changes phase from liquid phase to gaseous phase after heating of the working fluid and from a gaseous phase to a liquid phase with the removal of heat. In a Brayton cycle the working fluid does not change phase. Its working fluid remains a gas or super-critical fluid throughout the cycle. For working fluids like air, Helium, or Nitrogen this lack of phase change is appropriate since the pressures and temperatures required to enable a phase change are impractical.

The present invention is able to take advantage of a working fluid that undergoes a phase change in a closed loop portion of the engine. In a Rankine cycle the working fluid is cooled to a liquid phase before a pump or means of pressurizing is used to increase its pressure prior to heating of the working fluid. The expansion of the working fluid in this type of system provides for a much more efficient thermodynamic cycle than Otto or Diesel cycle engines and most Brayton thermodynamic power cycles.

As noted in the prior art, the work to compress a liquid is far less than the work required to compress a gas or super-fluid. The gains associated with less work input to compress the fluid will result in more net power; therefore, reducing the work required to pump the working fluid to the cycle's high pressure increases the net power produced by the engine. For this reason, Rankine cycle engines tend to be more efficient than Brayton cycle engines.

One objective of the present invention is to provide a closed loop operating system in which the working fluid in a low temperature and low pressure portion of the loop can either be a liquid (phase change—Rankine cycle), vapor (no phase change—Brayton cycle) or a supersaturated high density fluid. The ability to operate an engine in various thermodynamic cycles is a tremendous advantage in applications for which the engine can operate. Advantages for operating in different thermodynamic modes include; various working environment in which the engine can operate, various working fluids can be utilized with little or no alterations of the basic design, and various heating sources can be utilized to heat the working fluid. These advantages in the present invention are not found in the prior art and provide for a flexible operating engine for numerous applications.

The selection of working fluids has some but very little impact on the theoretical potential of efficiency for the various thermodynamic cycles in which the engine operates, and primarily the operating temperatures and pressures of the cycle control this feature. Many types of working fluids have been used in Rankine cycle type engines in the past, including; water, nitrogen, carbon dioxide ($CO_2$, propane, and various other organics. The working fluid to be used in a closed loop thermodynamic engine with an external heat source will depend on the range in which the heat source is able to produce heat and a heat sink source of a condenser in the closed loop. In the present invention, the engine is able to operate using various types of working fluids and the choice of the fluid would be dictated by the working environment in which the engine operates or the type of heat source to be used.

The selection of a working fluid is used to address the practical needs to transfer heat into the engine and to handle the working fluid as it changes phase. The present invention engine in one embodiment uses carbon dioxide ($CO_2$) as its working fluid due to its stable and non-reactive characteristic to very high temperature and remains a liquid to a very low temperature. This feature of $CO_2$ provides the potential for very high thermodynamic efficiency. There are practical challenges to using $CO_2$ as a working fluid because of its high critical pressure, yet relatively low critical temperature. Many of the features of the present invention address this particular technical challenge. The present invention also takes advantage of $CO_2$ thermodynamic properties, independent of its function as a working fluid for the Rankine cycle, for co-generation of refrigerant power and as a hydraulic power media for transferring mechanical power to various applications.

By using an external combustion process the in-efficiencies from integrating heat addition within the engine are eliminated. It allows the heat to be added to the cycle in a manner that does not compromise either the function of the engine or the efficiency and quality of the heat being provided. If the source of heat to the engine comes from the combustion of fuel and air, the control of the combustion can be optimized to maximize the heat provided and does not have to be constrained to the needs of the engine or its thermodynamic system. For example, to extract power from the engine, the pressure of the working fluid usually has to be maximized. For extracting heat from combustion, the pressure of the fuel and air mixture is not as critical and often not desired to be too high.

The external heat addition of the invention allows the needs of the power cycle to be addressed in design, and remain independent for the needs of heat addition. The mass flow of working fluid in the engine of this invention is also independent of the external environment and independent of the external heat addition. This means that power density of the engine can be increased by increasing the mass flow of working fluid through the engine. The fact that the working fluid of the thermodynamic cycle of the invention engine follows a closed-loop allows a separation of the power means of the engine from the heat addition means for the engine. It also allows the tailoring of the engine's working fluid to maximize power density and other important design considerations not possible if the working fluid is restricted to air in the engine's environment. One simple benefit of this arrangement is that the available power from the engine is not strongly dependent upon the density of the air of its environment. The power available from the invention engine is only dependent upon air density to the extent the external heating is dependent upon air density.

Most if not all of the prior art that takes advantage of an external heat source applied to a closed loop system describes expansion of the high pressure working fluid through a turbine type device. Turbines are an excellent means for converting thermal energy into mechanical energy with only a couple limitations. Turbines condition the flow of the working fluid by converting pressure into flow velocity to convert momentum into useful work. This requires the turbine to operate at high rotational velocity to achieve desired efficiencies of energy conversion. This results in the drive shaft, connected to the turbine, to also have a high rotational speed. A transmission device is required to make the shaft speed of the turbine useful for various applications. The present invention is a positive displacement device and converts pressure into work by direct expansion of pockets or discrete volumes of working fluid. The expansion of discrete volumes of working fluid within one or more scroll expanders enables a shaft output to operate more efficiently over a wide range of rotational velocities. By providing a means for obtaining a range of rotational speeds without losing efficiency provides a user with a wide variety of outputs or speed conditioning for useful applications. For example, rotational speeds needed for a generator, hydraulic pump or motor can be easily produced from the same scroll expander with little or no modification to the closed loop system.

Another objective of the present invention is to provide a means for converting high pressure working fluid into useful work in a small, lightweight package. A turbine is designed to concentrate the high pressure working fluid near or at the external lines of the turbine casing. The center portion of the turbine is occupied with the rotational element of the turbine itself, including a shaft, bearings, and seals. With high pressure fluid flow at the outer portions of the turbine casing, additional weight is necessary for maintaining the turbines integrity. The present invention is able to minimize the effects of high pressure working fluids loading a casing or engine block in which the scroll expander is placed. The scroll expander receives the high pressure working fluid at the center of the scroll expander with expansion of the working fluid decreasing as the working fluid travels through the scroll expander. The periphery of the casing or engine block is presented with a relatively lower pressure working fluid and therefore less weight is needed to maintain the integrity of the closed loop. This center out pressure reduction in a scroll expander of the working fluid results in a lighter and more compact thermal expansion device or engine block.

BRIEF SUMMARY OF THE INVENTION

The present invention claims a high efficiency engine capable of operating in a variety of thermodynamic modes, including a Rankine, Brayton, or supercritical cycle. The engine is comprised of a closed circulating system containing a working fluid, the system including: means to raise the pressure of said working fluid from a low cycle pressure to a high cycle pressure; means to add heat to said fluid substantially at said high cycle pressure to raise it to its high cycle temperature substantially above its critical temperature; means to expand said fluid by use of at least one scroll expander to do useful work; means to cool said fluid substantially at said low cycle pressure to a low cycle temperature; and said means to raise the pressure of said working fluid being provided from the useful work of said at least one scroll expander. Additional efficiency is captured using means to regeneratively transfer a portion of the working fluid's heat to the pressurized fluid as one means to cool said fluid.

The temperature and pressure of the working fluid can vary depending on several factors producing a very flexible operating system for use in a wide variety of application using a variety of working fluids and heating sources. To achieve a Rankine cycle mode of operation the means to cool said fluid at said low cycle pressure reduces the temperature of said fluid substantially below its critical temperature to render it completely liquid for entrainment by said pressurizing means. For a Brayton cycle mode the working fluid at said low cycle temperature is at or above the critical temperature of said working fluid. And for a supercritical mode of operation the low cycle pressure in said system is substantially above the critical pressure of said working fluid and said low cycle temperature is below critical temperature of the working fluid. The same engine is capable of operating in various thermodynamic modes with little or no changes to the system components.

The engine's operating environment, heat source and choice of working fluid will influence the mode of operation for the engine. The choice of working fluid will depend upon several factors including the type of heat source, the working environment in which the engine operates, and the compatibility of the engine components. In the description provided below, $CO_2$ as the working fluid is provided since this working fluid is readily available, operates over a fairly wide range of working environments, is non-reactive and is compatible with most all types of materials.

In the preferred embodiment, a pair of scroll expanders connected by a common shaft is used for a low weight, small package device that is able to produce a variety of power conversion means. In the preferred embodiment, the orbital shaft's rotations provide the power to operate at least one variable displacement pump. By using a variable displacement pump as a means for converting mechanical energy to hydraulic or fluid energy, the working fluid operating pressure is easier to maintain and a wider variety of energy outputs can be realized.

High pressure fluid energy can be used for mechanical drive means for propulsion such as; wheels, or tracks for land vehicles, propeller screws, pumps, jets, or paddles for marine vehicles, or rotors, fans, or propellers for both heavier than air and lighter than aircraft.

Other forms of power transfer including the conversion of high pressure working fluid, in a liquid state, into mechanical or hydraulic outputs such as actuators, motors and electrical generation with re-introduction of the working fluid as return flow back into the engine cycle. Pressurizing a secondary fluid to minimize penetration of an engine block assembly can provide mechanical means for power transfer into a variety of applications including hydraulic motors, generators or direct motive applications. Additionally, power conversion of the high pressure working fluid can also be provided for co-generation of high-pressure liquid for a refrigerant cycle, with return of warm low pressure working fluid back into the engine cycle. Finally a direct shaft power pick off of the orbital shaft rotation can be obtained with torque being applied for various applications.

DETAILED DESCRIPTION OF THE INVENTION

Various embodiments of the invention will now be described. The following descriptions provide specific details for a thorough understanding and enabling description of these embodiments. It should be noted, however, that the above "Background" describes technologies that may enable aspects and embodiments of the invention. One skilled in the relevant arts will understand, however, that the invention may be practiced without many of these details. Additionally, some well-known structures or functions may not be shown or described in detail, so as to avoid unnecessarily obscuring the relevant description of the various aspects and embodiments of the invention.

The terminology used in the description presented below is intended to be interpreted in its broadest reasonable manner, even though it is being used in conjunction with a detailed description of certain specific embodiments of the invention. Certain terms may even be emphasized herein; however, any terminology intended to be interpreted in any restricted manner will be overly and specifically defined as such in this Detailed Description section.

Figure 1:
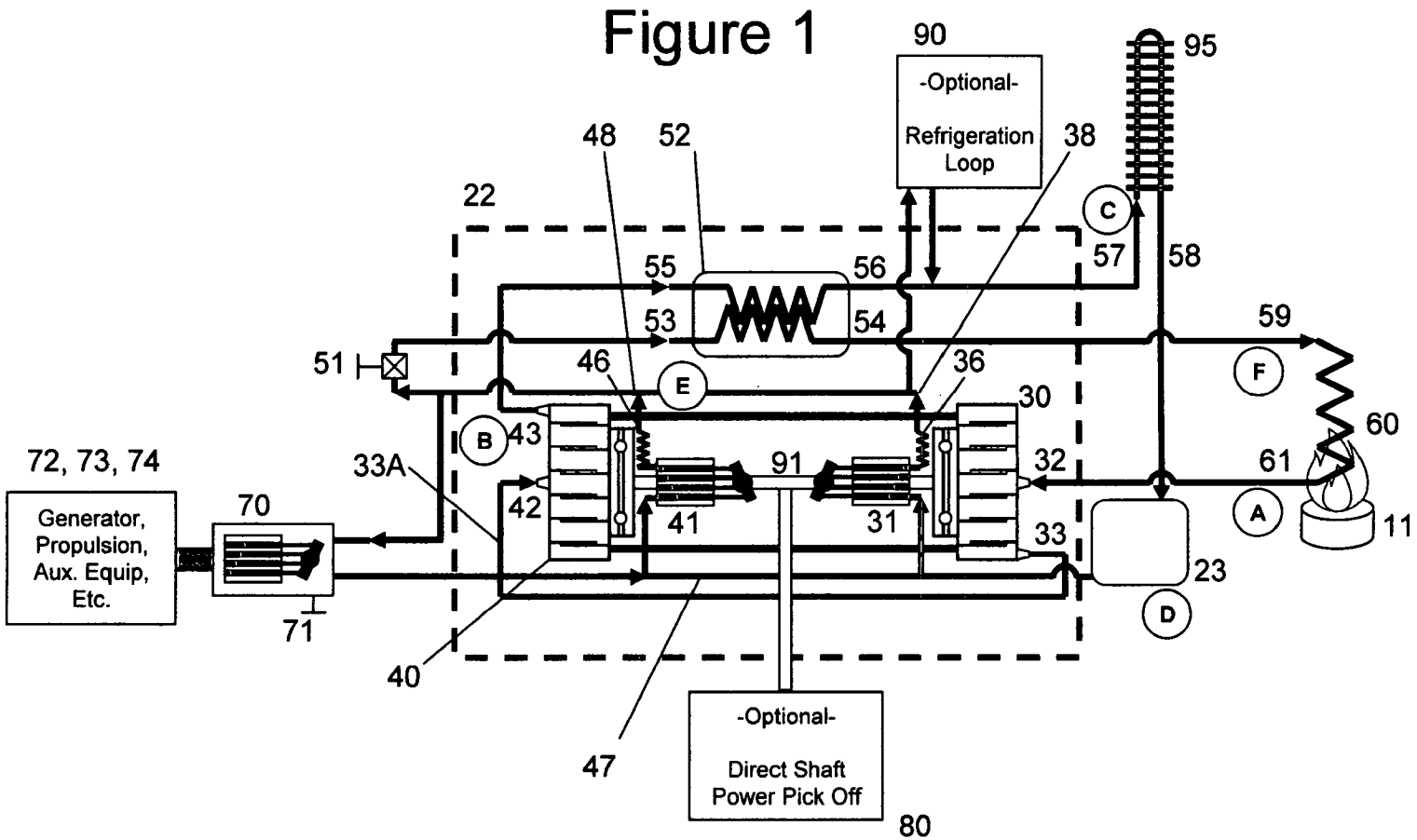
FIG. 1 a schematic of an engine with an external heat source being applied to a closed loop system containing; a balanced pair of scroll expanders, a set of variable displacement pumps associated with the each expander, several means for exploiting either the high pressure fluid discharged by the variable displacement pumps or direct linkage to a rotary shaft of the scroll expanders, and other supporting components.

FIG. 1 is a schematic of a power conversion system or an engine with energy from an external heat source 11 being converted in a closed loop assembly to a desirable form of energy. To describe this process, a narrative of the working fluid in the closed loop is explained with additional detail of the various parts of the system being supplied with respect to the processing of the working fluid around the closed loop. In one embodiment, a working fluid, most likely carbon dioxide ($CO_2$), will operate at pressures and temperatures generally above supercritical pressure and mostly above supercritical temperature however system pressures and temperatures can be much more expansive—falling below critical temperature and pressure—to operate the engine and will depend upon several factors including; an operating environment in which the system is located, source or type of external heat applied to the closed loop, heat sink temperatures and other factors associated with the various components of the system and will be discussed as alternative embodiments of the present invention.

Figure 2A:
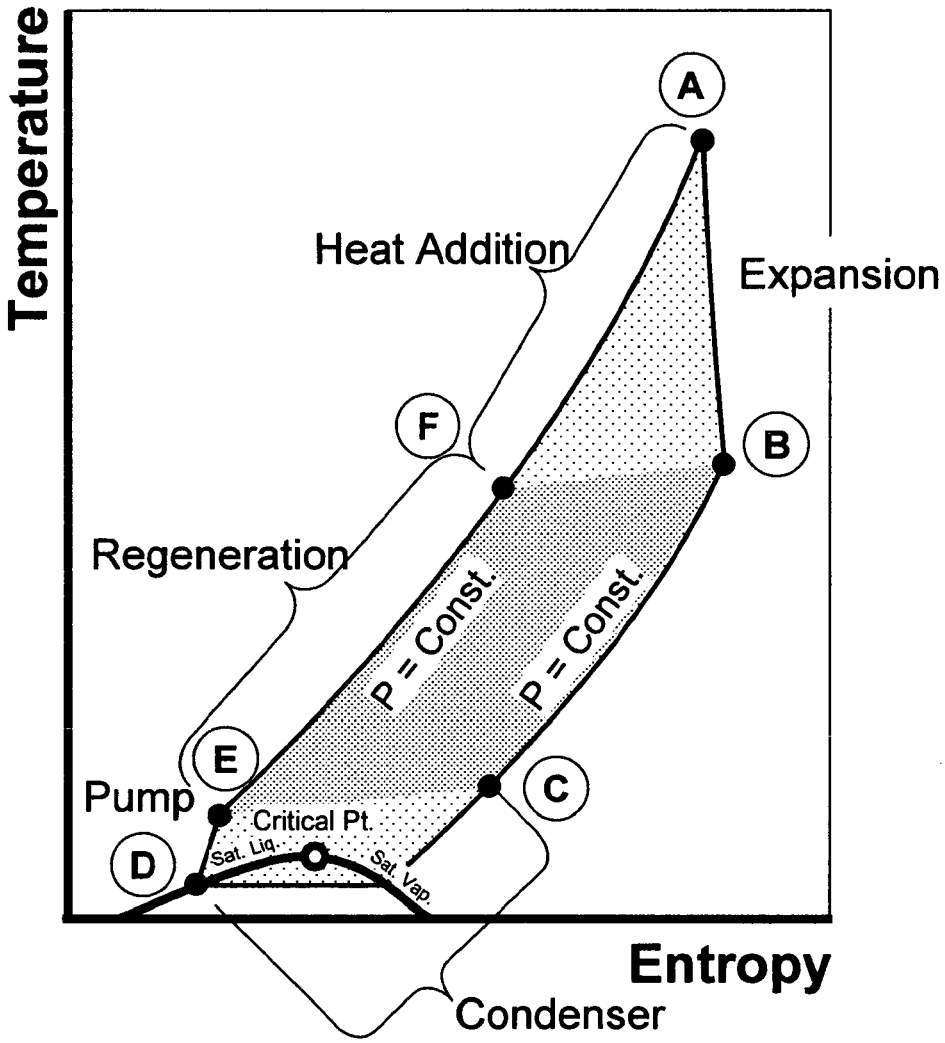
FIG. 2*a* is a temperature-entropy diagram illustrating a process in which the engine will operate in a thermodynamic cycle similar to a Rankine cycle.
Figure 2B:
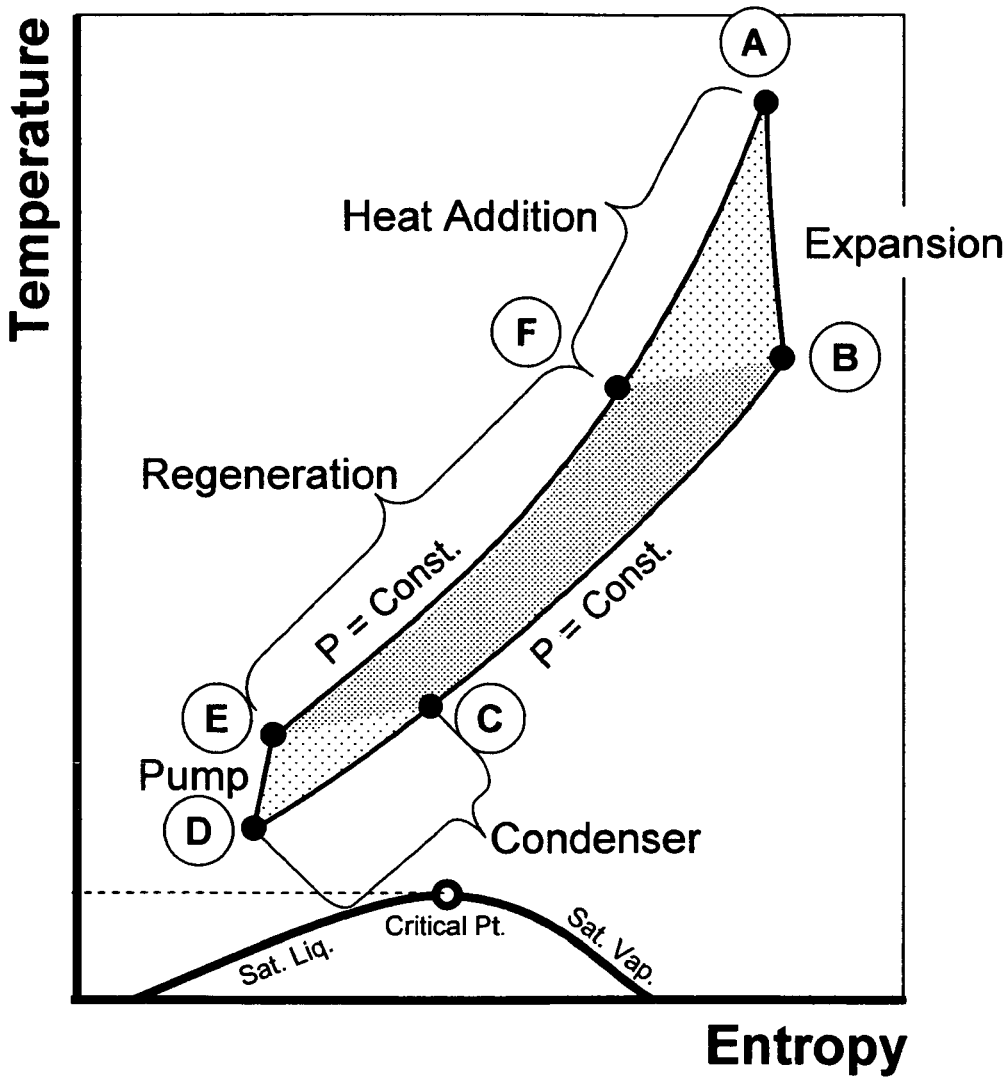
FIG. 2*b* is a temperature-entropy diagram illustrating the process in which the engine will operate in a thermodynamic cycle similar to a Brayton cycle.
Figure 2C:
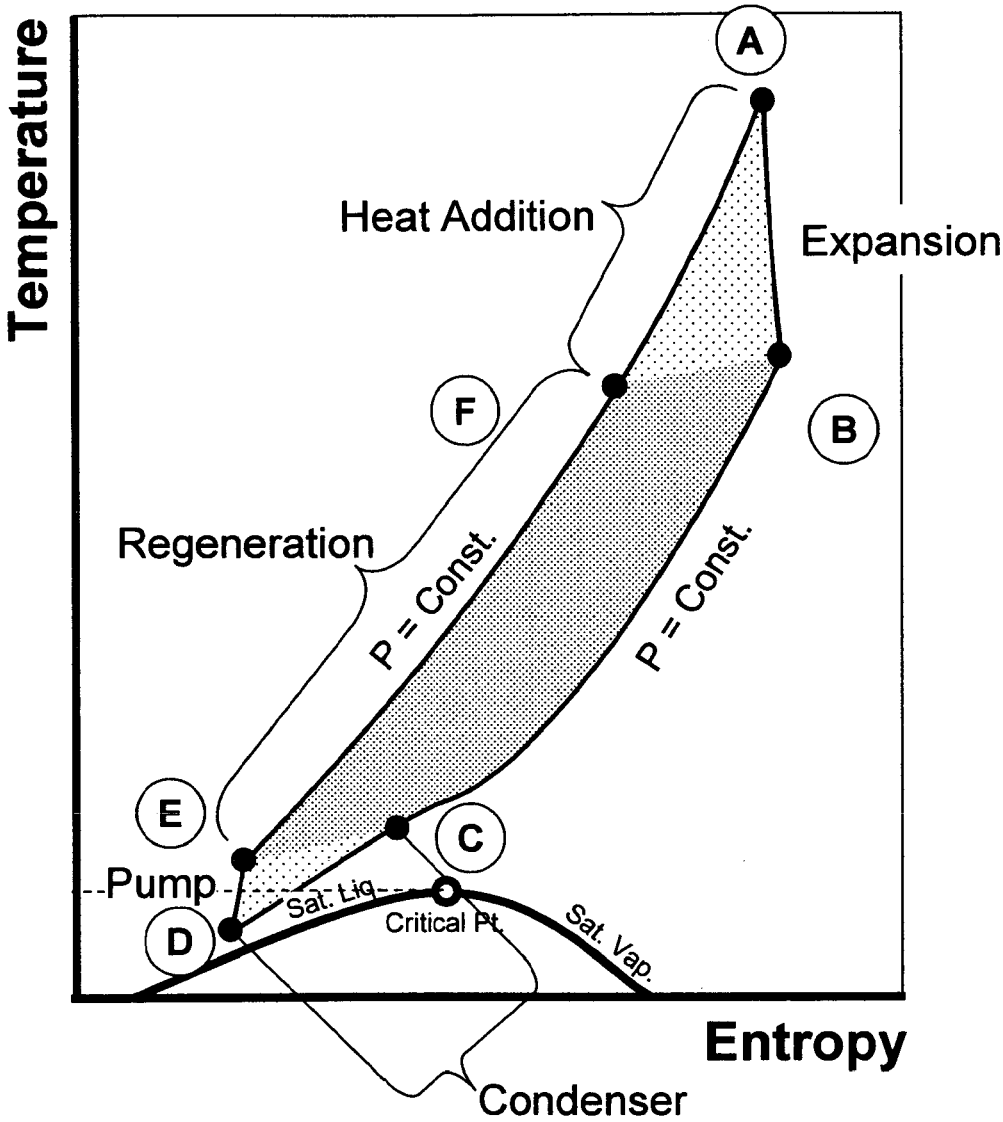
FIG. 2*c* is a temperature-entropy diagram illustrating the process in which the engine will operate in a thermodynamic cycle in which the working fluid's pressure is above critical pressure throughout the closed loop even at a low cycle pressure and the working fluid's temperature is below critical temperature at a low temperature cycle of the closed loop.

To start the narrative, from FIG. 1 and FIG. 2*a* point A being at the outlet of an evaporator 60 where the working fluid is at its highest temperature and pressure. Upon leaving the evaporator, the working fluid is directed to an engine assembly 22 which contains most of the necessary components for power conversion. At this point in the closed loop, the working fluid is at its highest temperature and pressure. FIGS. 2*a*, 2*b* and 2*c* are temperature-entropy diagrams that correspond to the temperature and entropy of the working fluid as the working fluid is processed through the closed loop. The three cycles, Rankine, Brayton, and supercritical, represent various modes of operation the present invention is capable of operating in.

The temperature for highest overall efficiency should be as high as possible and only constrained by the temperature of the heat source, integrity or technical aspects of the system, and the working fluid selected. In the preferred embodiment, the working fluid will have characteristics the same as or similar to carbon dioxide, $CO_2$, for example with CO2 the temperature range will be as high as 1800K. The pressure of the working fluid is selected by design consideration of the regenerative heat exchanger, the desired low pressure of the cycle, and the level of expansion intended for power extraction. Operating pressures will be above 200 bar. FIG. 2*a* depicts a generic temperature entropy diagram of a closed loop operating system. Point A depicts the working fluid at its highest temperature and highest pressure prior to entry into the engine block assembly 22. FIG. 2*a* is a depiction of a Rankine thermodynamic cycle and as discussed earlier, a very efficient means for converting thermal power to work out. The working fluid is cooled to a liquid for efficient pressurizing later in the process.

In the preferred embodiment, the assembly 22 represents a type of engine block in which the high pressure and temperature of the working fluid is more easily maintained with fewer opportunities for loss of working fluid from numerous joints, gaskets, and other components less able to handle the high pressure and temperature of the supercritical working fluid. By directing high pressure working fluid through penetrations into and out of the engine assembly, the integrity of the closed loop is more easily maintained and therefore smaller and more compact. The engine assembly is a preferred embodiment of the system but in no way limits the scope of the claims and is only meant to describe one embodiment.

As the high pressure and temperature working fluid enters the engine assembly, the working fluid enters a first scroll expander 30 through an inlet line 32 in the assembly. The working fluid is directed to a first scroll expander intake chamber 32*a*, see FIGS. 3 and 4.

The operation of the scroll expander is similar to the description provided in U.S. Pat. No. 801,182 originally proposed by Léon Creux in 1905. The first scroll expander 30 has a fixed 34 and orbital 35 scroll plate that are integrated in such a manner as to create isolated chambers of ever increasing volume from the intake chamber 32*a* where the high pressure working fluid first enters the scroll expander. The fixed scroll plate 34 has a spiral band 85 axially mounted to the face of the plate projecting in toward the orbiting scroll plate, the spiral band is shaped as an involute curve on the plate face as can be seen on FIG. 4. The orbiting scroll plate 35 has a spiral band 86 axially mounted to its face and the spiral is configured counter or reversed from the spiral band 85 affixed to the fixed scroll plate 34 such that when the orbiting scroll plate 35 and fixed scroll plate 34 are engaged or integrated, the spiral bands of the fixed and orbiting scroll plate contact each other at several points along the length of the bands creating two crescent shaped zones, like zones 83*a* and 83*b* shown on FIG. 4 within the pair of spiral bands. The number of contact points between the orbital scroll 35 and the fixed scroll 34 are a function of the length of the spiral band and the size of the scroll expander. At the periphery of the first scroll expander fixed plate is an outlet 33 where lower pressure working fluid leaves the first scroll expander. The working fluid at this point still retains significant thermal energy with the pressure reduction of the working fluid being a function the spiral band lengths and width of said spiral bands. The result of integrating the fixed and orbital scroll plates is a scroll expander 30.

The expansion of the working fluid within the expander causes the orbital plate to orbit or move in a circular path, refer thereto FIG. 4 through 8. When the high pressure fluid is introduced into the scroll expander as depicted by the darker area near the center in FIG. 4, the fluid occupies the high pressure intake chamber 32*a* and surrounds the innermost portions of the spiral bands 85 and 86 of the orbital and fixed scroll plates, with the contact points between the fixed and orbital spiral bands providing a means for separating and isolating the incoming fluid from the radially outward moving crescent shaped zones 83*a* and 83*b* as seen in FIG. 4 through 8. It should be noted that one of the benefits of this design is the elimination of valving and timing mechanisms necessary in Otto and Diesel cycle engines. The working fluid is continuously being cycled through the closed loop and the engine requires no valving and does not require specialized timing for combustion of the external heat source or pressurization.

Figure 4:
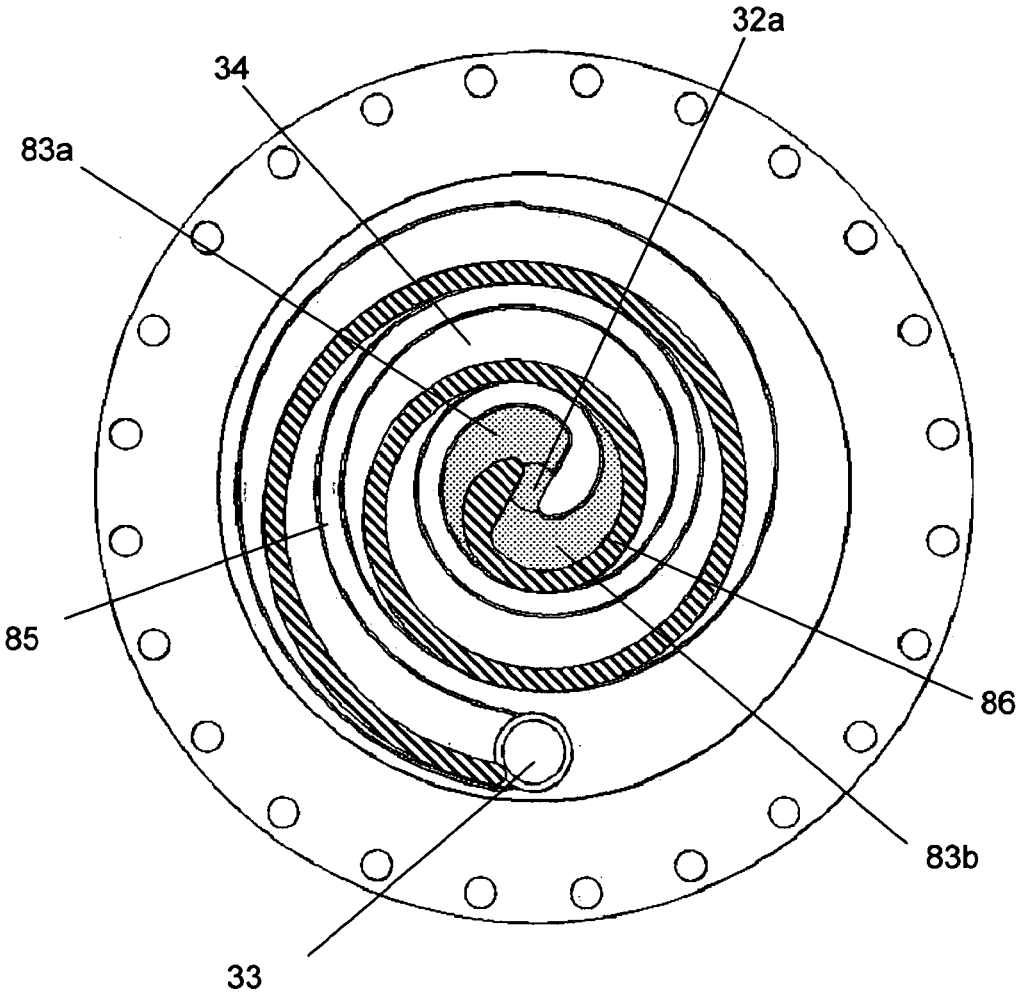
FIGS. 4-8 are cross-sectional end view of the first and second scroll expander. The end views of the first and second scroll expanders are similar and the numbering within the detailed description of the parts covers both scroll expanders. The view shows a fixed scroll plate with internals of the fixed and orbital scroll plate spiral bands integrated in such a manner as to display discrete volumes or pockets within the integrated plates. The various views from FIG. 4 through 8 show various positions of the fixed and orbital spiral bands and a volume of working fluid passing through said expander through one orbital rotation with FIG. 4 being zero degrees, FIG. 5 being 90 degrees orbital rotation from FIG. 4, FIG. 6 being 90 degrees orbital rotation from FIG. 5, FIG. 7 being 90 degrees orbital rotation from FIG. 6, and FIG. 8 back to zero degrees or 90 degrees orbital rotation from FIG. 7.
Figure 5:
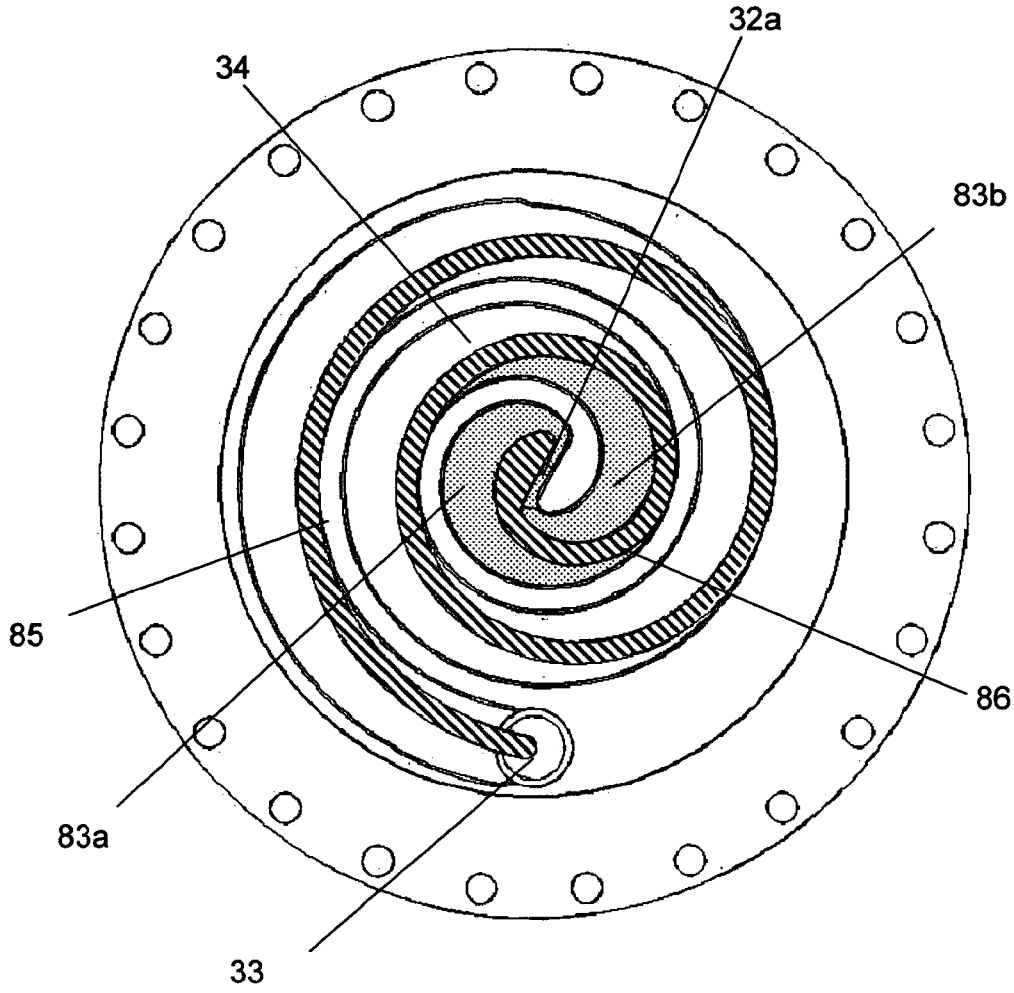
Figure 6:
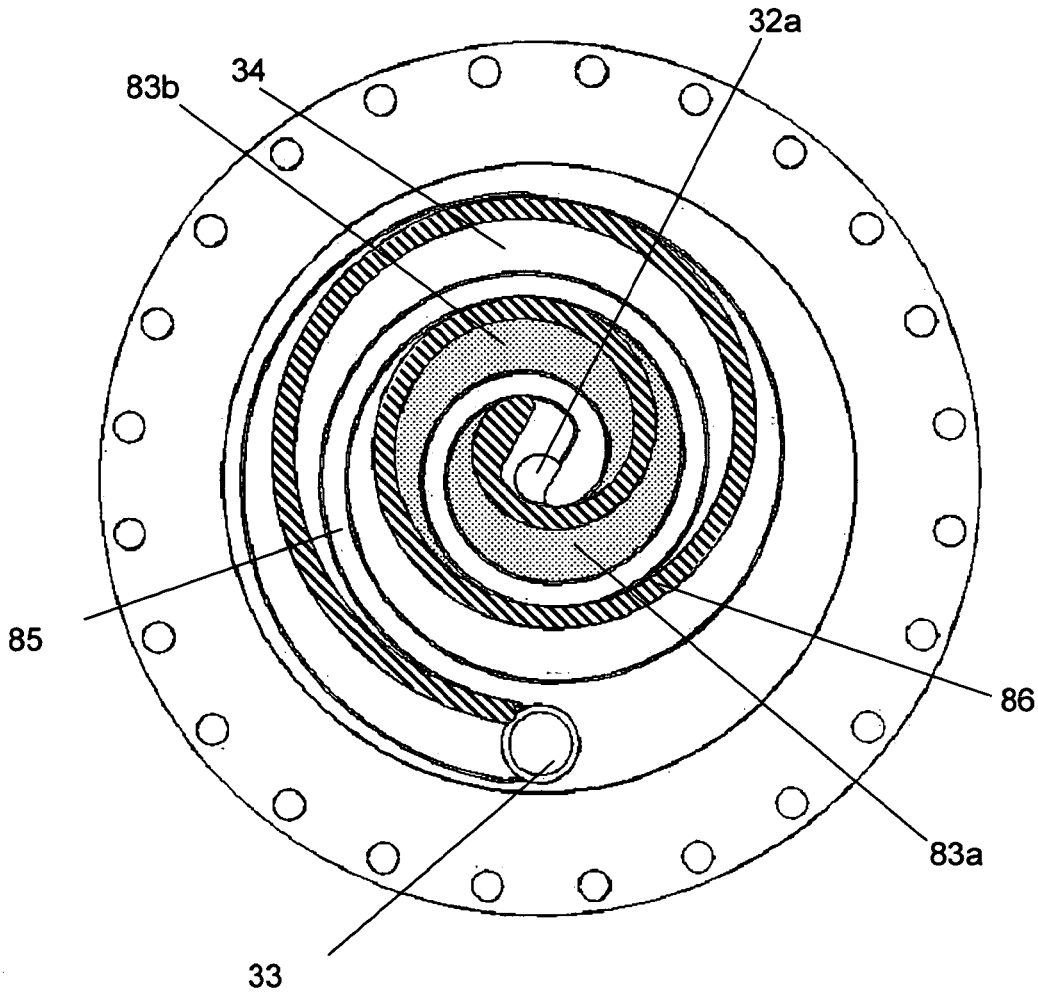
Figure 7:
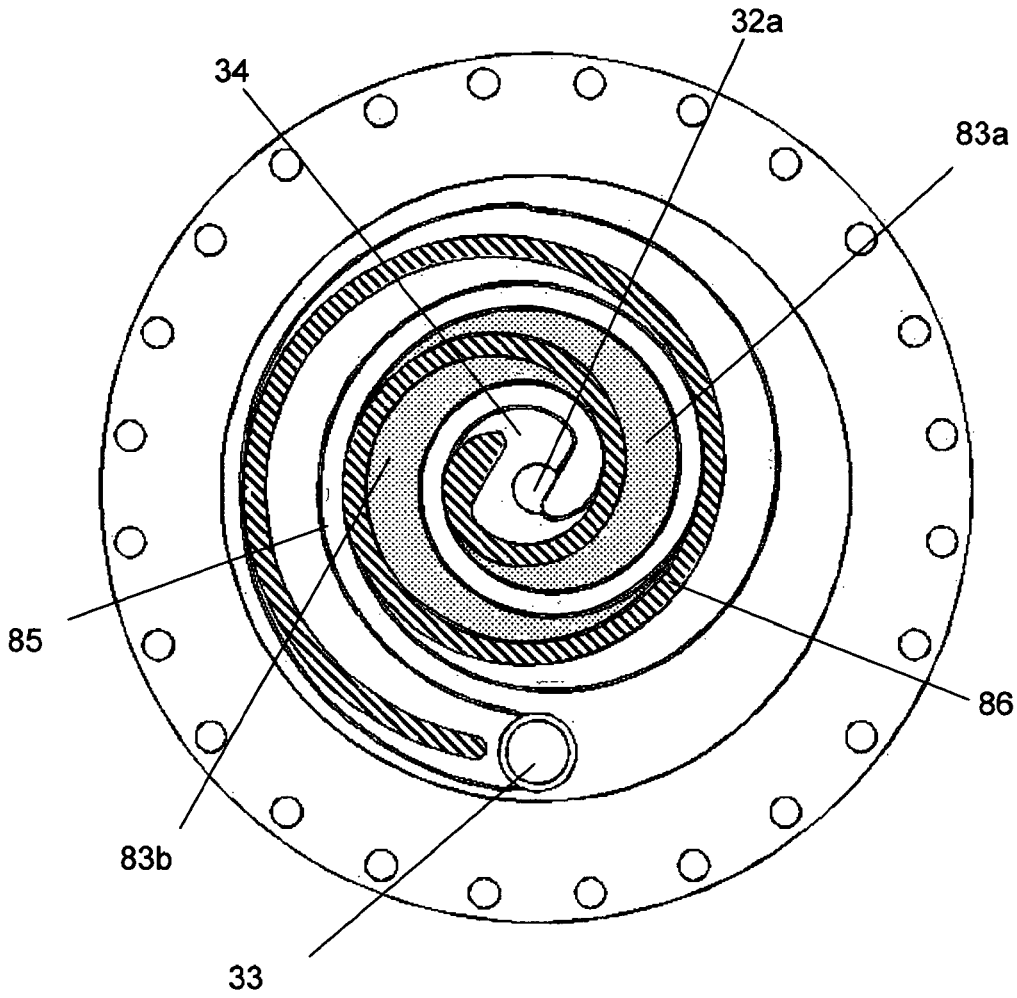
Figure 8:
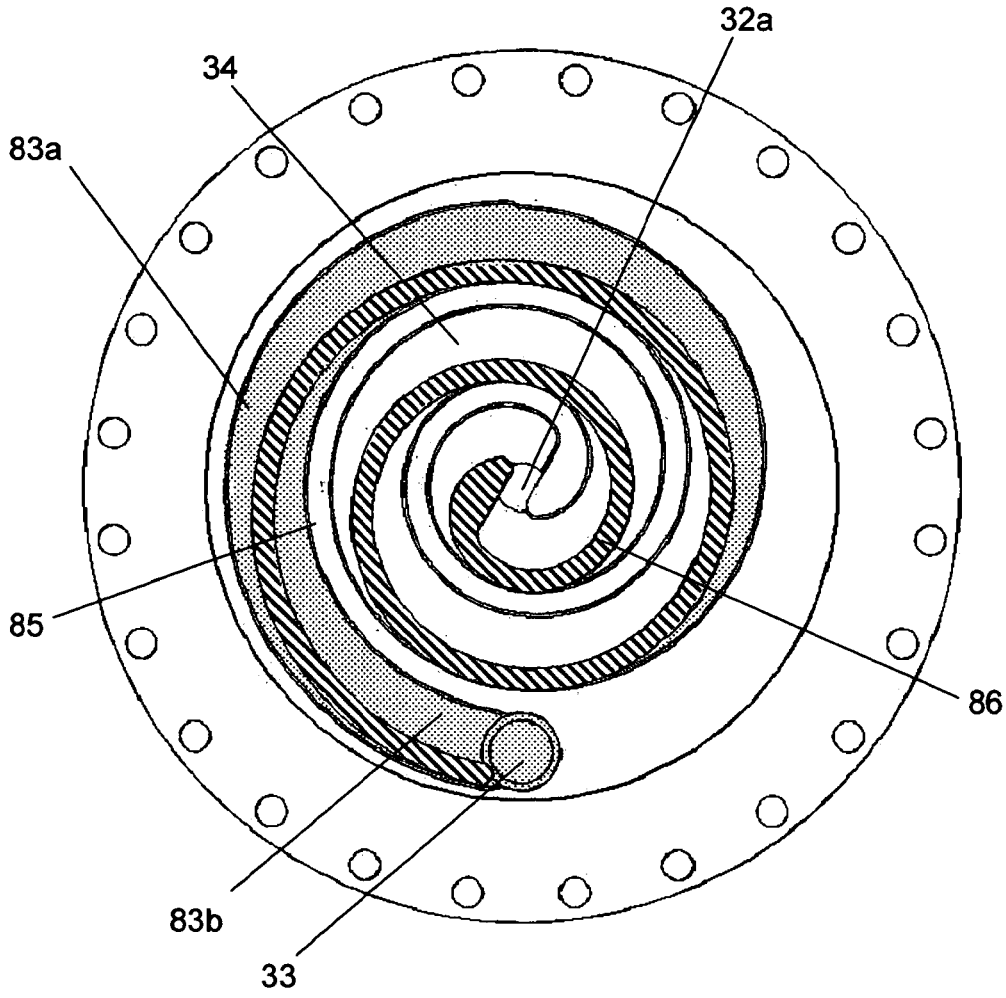

In FIG. 4 said orbital plate is at 0 degrees of the circular orbit of said orbital plate, the high pressure fluid contacts the inner wall of the crescent shaped volume of the orbital plate, the high pressure working fluid moves the orbital plate out and in a radial path. As the working fluid moves the orbital plate in an orbital path, the crescent shaped volumes increase in size allowing the working fluid to expand, see FIG. 4 through FIG. 8 depicting one crescent shaped volume during orbital rotation from zero degrees through 360 degrees.

Figure 3:
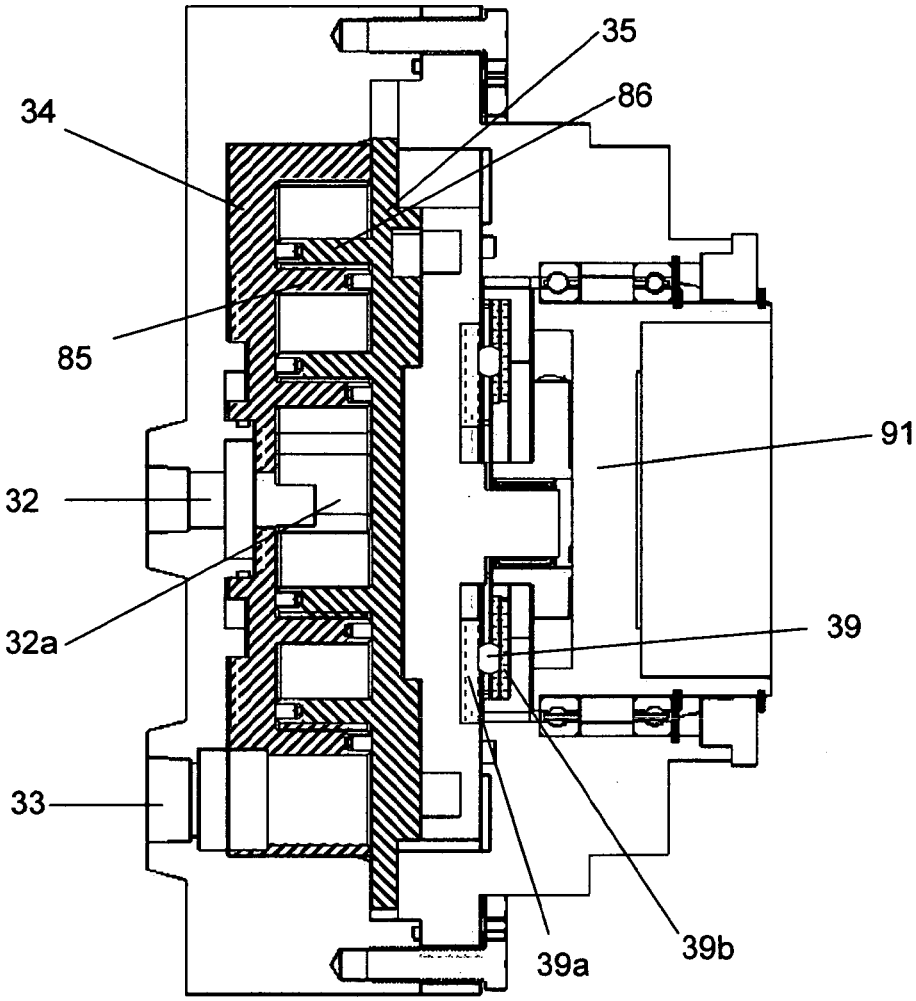
FIG. 3 is a cross-sectional side view of a scroll expander showing a fixed scroll plate and an orbital scroll plate and integration of the two scroll plates by a set of spiral bands attached to each plate.

The orbital path of the orbital scroll plate is accomplished by the integration of the spiral bands within the scroll expander and the limited rotational movement of the orbital scroll plate due a set of thrust bearings 39 located on the opposite side of the spiral bands of the orbital scroll plate, see FIG. 3. In one embodiment, the thrust bearings will be a fixed bearing plate 39*a* attached to the engine assembly and another bearing plate 39*b* attached to the orbital plate with ball bearings 39*c* situated between the bearing plates allowing limited movement for the orbital plate of the first scroll expander.

The technology associated with a thrust bearing providing means for rotation and sealing protection with respect to the orbital scroll plate and fixed plate is well known to those skilled in the art. Many embodiments of various systems are found in the prior art, especially scroll technology associated with compressors.

As the working fluid is expanded through the first scroll expander the working fluid's pressure will decrease with a decrease in temperature. This expansion is the conversion of the thermal energy into the mechanical energy of the scroll expander. The efficiency and power output of the scroll expander are not only a function of the operating pressure but a function of the size and depth of the spiral bands of the fixed and orbital scroll plates. The ability of the scroll expander to convert thermal energy into working energy is dependent on a number of factors. The most easily manipulated factor is the length and width of the integrated spiral bands of the orbital and fixed scroll plates. The longer the spiral band or the deeper the width of the spiral band, the more power is converted from thermal energy to orbital movement of the orbital plate.

There are several means by which the scroll expander is able to convert thermal energy into some other form of work. In one embodiment, the fixed scroll plate 34 has two sides with one side having the spiral band 85 described above and the other side being attached to the engine assembly 22. The orbital scroll plate has two sides with one side having the spiral band 86 described above and the other side of the orbital plate being attached to one end of an orbital shaft 91 contained within the engine assembly 22. In one embodiment of the invention, at least one variable displacement pump 31 is connected to the orbital shaft 91.

In the preferred embodiment of the present invention as depicted in FIG. 1, a swash plate variable displacement pump is turned or rotated from the orbital motion of the orbital shaft attached to the orbital plate of the first scroll expander. A swash plate variable displacement pump is not a novel concept and is well known to those skilled in the art of pumps and hydraulic systems. The pump is integrated with the first scroll expander 30, by means of the orbital shaft 91, with the orbital rotation of the orbital plate causing the rotation of the shaft. In one embodiment, the swash plate variable displacement pump increases the pressure of the working fluid (Note: this is the same working fluid that enters the scroll expander described above but at a later stage in the closed loop and will be discussed below) and the high pressure working fluid at the pump outlet can be converted into a variety of other uses, such as being used in a liquid variable displacement motor or generator.

Variable displacement pumps, or in the preferred embodiment swash plate pumps, are used because they are efficient, have variable displacement, operate efficiently at different speeds, and have high power density. Typically, swash plate pumps are designed to deliver a constant output pressure. The variable displacement pumps will automatically adjust their displacement as required to maintain outlet pressure regardless of the speed of the scroll expander or feed pressure of the working fluid at the pump inlet.

By using a variable displacement pump, the engine is able to produce constant or reactive work output while maintaining a high level of efficiency through a broad spectrum of shaft speeds. Turbines engines are limited in that the turbine is most efficient when the turbine is operating at high speeds with tremendous pressure differential. A turbine is not capable of operating at a slower speed without significant efficiency degradation. Piston engines are capable of operating in various speeds but lack the ability to operate efficiently at other than optimum operating speeds.

In the first scroll expander 30, when the working fluid is expanded during the orbital rotation of the fixed and orbital plates the fluid reaches the periphery of the scroll expander and exits through an annulus or outlet 33 located within the fixed plate wall to an outlet line 33*a*. The working fluid still retains a significant amount of thermal energy and is able to be expanded further. In one embodiment of the invention, to accomplish further expansion, the first scroll expander outlet line 33*a* directs the working fluid to an inlet 42 of a second scroll expander 40.

The second scroll expander 40 is similar to the first scroll expander with the orbital plate 45 of the second scroll expander connected to the same orbital shaft 91 of the first scroll expander. This connection of the second and first scroll expanders allows for a more efficient machine. The expansion of the working fluid through the second scroll expander is similar to the first scroll expander. The size, depth and shape of the spiral bands of the second scroll expander can be manipulated to enhance the output between the first and second scroll expanders.

As the working fluid enters an inlet chamber 42*a*, of the second scroll expander 40. The second scroll expander 40 has a fixed 44 and orbital 45 scroll plates that are integrated in such a manner as to create isolated chambers of ever increasing volume from the intake chamber 42*a* where the high pressure working fluid first enters the scroll expander. FIG. 4 through FIG. 8 depicting an orbital rotation of the first scroll expander 30 is the same as the second scroll expander and the only difference would be the part numbers associated with the components. The fixed scroll plate 44 has a spiral band 87 axially mounted to the face of the plate projecting in toward the orbiting scroll plate, the spiral band is shaped as an involute curve on the plate face. The orbiting scroll plate 45 has a spiral band 88 axially mounted to its face and the spiral is configured counter or reversed from the spiral band 87 affixed to the fixed scroll plate 44 such that when the orbiting scroll plate 45 and fixed scroll plate 44 are engaged, the spiral bands of the fixed and orbiting scroll plate contact each other at several points along the length of the bands creating several crescent shaped zones, like zones 84*a* and 84*b* within the pair of spiral bands. The number of contact points between the orbital scroll 45 and the fixed scroll 44 are a function of the length of the spiral band and the size of the scroll expander. At the periphery of the second scroll expander fixed plate is an outlet 43 where the now lower pressure working fluid leaves the second scroll expander. The working fluid at this point is considered exhaust fluid.

In one embodiment as depicted in FIG. 1, an additional variable displacement pump 41 is connected to the orbital shaft in balance with a first variable displacement pump 31. The same configuration is used for both variable displacement pumps—again a swash plate variable displacement pump is the used in the preferred embodiment with the working fluid being pressurized and the working fluid at the outlet 38 and 48 of the first and second variable displacement pumps being directed to one or more means for converting said high pressure working fluid to some other form of energy.

After the working fluid has been expanded for a second time through the second scroll expander 40, the working fluid or exhaust fluid still retains significant amounts of thermal energy, and from FIG. 2*a*, the working fluid is now at B on the graph having a significant amount of work taken from the expansion of the working fluid in the form of orbital shaft rotations. The high temperature of the exhaust fluid, at point B, is transferred to the working fluid at point E that is being directed to the evaporator prior from the outlet of the variable displacement pumps. This transfer of thermal energy is accomplished using a regenerative heat exchanger 52. The regenerative heat exchanger 52 can be integrated within the engine assembly or placed outside the assembly—the function of the device remains the same. The benefits for using a regenerative heat exchanger are detailed in U.S. Pat. No. 3,237,403. In one embodiment, the critical pressure of the exhaust fluid and the high pressure low temperature working fluid that enter the regenerative heat exchanger are above critical pressure for optimum efficiency.

It should be noted that the first and second scroll expander are not limited to a fixed and orbital plate, instead recent designs, such as U.S. Pat. No. 4,927,339, issued to Riffe et al., have incorporated relative orbital movement between two plates having spiral bands that when integrated form discrete volumes of space like the fixed and orbital face plates described above. This relative orbital movement requires both plates to orbit or move in an orbital path with respect to each other. The discrete volume of space created by the integrated plates increase as the space moves radially toward the periphery like the fixed and orbital face plates but both plates are moving. The same effect is obtained and the present invention is meant to incorporate a scroll expander with either method of orbital rotation between two plates.

In the description of the present invention reference is made to a fixed and orbital face plate. A more generic and applicable phrasing for a scroll expander would include a pair of integrated face plates that have a relative orbital motion between a set of spiral bands attached to said face plates. The spiral bands are integrated and form at least one discrete volume of space between connecting points of the spiral bands of the two face plates. When there is relative orbital movement between the two face plates the discrete volume is radially transferred to the periphery and the volume of said discrete space increases toward the periphery. The description of the present invention is not meant to be limited with respect to the type of scroll expander that is employed and the use of the scroll expander is meant to encompass all types and varieties of scroll expanders.

When operating as a Rankine cycle engine, the hot gaseous exhaust fluid needs to be converted to a liquid prior to pressurizing the fluid and entry into the evaporator 61. By passing the hot gaseous exhaust fluid through the regenerator 52 the engine increases its efficiency greatly. The working fluid passing on the other side of the regenerator from the exhaust side absorbs the thermal energy and goes from liquid state, point E to point F on FIG. 2, and approaches partial phase change prior to entering the evaporator where the liquid is completely converted to a gaseous phase, point A.

When the exhaust fluid exits the regenerative heat exchanger the working fluid is at a lower pressure but still in a gaseous phase, to complete the phase change to a liquid, the working fluid, now at point C on FIG. 2, is passed through a condenser 95 that will typically be outside the engine assembly shown in FIG. 1. The type of condenser used in the present invention will depend on the operating environment in which the engine is to be used. The prior art is replete with description of condensers and this application is not intended to capture innovation associated with the condenser. In the preferred embodiment and the most efficient operating mode of the engine, the working fluid is converted from a gaseous phase to a liquid phase in the condenser at this point the working fluid is at point D on FIG. 2.

In one embodiment of the engine, after the working fluid exits the condenser, the working fluid is collected in a reservoir 23 prior to being pressurized by the first and second variable displacement pumps attached to the first and second scroll expanders 30 and 40. The working fluid upon discharge from the variable displacement pumps is at point E on FIG. 2.

By completing the phase change of the working fluid from gaseous phase to a liquid phase in the condenser, the work needed to increase the pressure of the working fluid prior to heat being added is significantly reduced as explained in U.S. Pat. No. 3,237,403 issued to Feher disclosing a closed loop supercritical regenerative heat engine and U.S. Pat. No. 7,284,363 issued to Kung, et al, disclosing a use for a closed loop supercritical regenerative heat engine in an aircraft above 50,000 feet.

In one embodiment of the invention, the working fluid once pressurized, point E on FIGS. 1 and 2, is used as a cooling fluid for the moving parts of the first and second scroll expanders as depicted by a first engine housing cooler 36 and second engine housing cooler 46. By acting as a cooling source for the scroll expanders, thrust bearings, and orbital shaft, the working fluid is able to capture additional heat energy potentially lost in the closed loop of the engine.

In one embodiment of the engine, as the working fluid exits the first and second engine housing coolers 36 and 46, the working fluid is directed to a working fluid drive as depicted by the variable displacement motor 70 of FIG. 1. In the preferred embodiment, the drive is a variable displacement hydraulic motor using high-pressure liquid $CO_2$ as its working fluid. The output of the orbital shaft rotations is translated into a high pressure fluid that is more easily transferred outside the engine assembly. Transfer of high pressure working fluid outside of the engine housing is easier in that fewer and small penetrations into the engine housing will reduce the likelihood of leaks and thereby maintain system pressure.

Another embodiment for accomplishing a similar power transfer as described above is to utilize a secondary working fluid that is pressurized by means of a variable displacement pump connected to the orbital shaft—similar to the description above using the working fluid. In this embodiment, the secondary working fluid is separate from the working fluid of the closed loop and pressurized by a variable displacement pump attached to the orbital shaft. The high pressure secondary working fluid would then pass out of the engine assembly and be used for capturing power in various forms such as an hydraulic motor or generator. The secondary working fluid is then returned to the engine assembly and pressurized again for reuse—a second closed loop. Pressurizing a secondary working fluid could be accomplished by connecting a variable displacement pump to the orbital shaft as described above. The working fluid of the first closed loop could be pressurized by one or more separate pumps attached to said orbital shaft. Flexibility in utilization of the rotating orbital shaft is one of the benefits of using a scroll expander since the rotational speed of the orbital shaft can be varied depending on the desired speed of rotation needed.

Experiments and studies have shown that the pressure of the working fluid of the closed loop will be above 200 atm. and probably much higher with the pressures in the pump and shaft compartment of the engine assembly above 75 atm. A pressure penetration in the engine assembly to obtain a direct rotational shaft output will likely have significant frictional losses as well as degrading the integrity of the closed loop working fluid pressure. Designing a system for a direct power transfer from the orbital shaft rotations is possible but requires significant engineering and additional moving parts to maintain a high efficiency output. Therefore power conversion by means of hydraulic power transfer is one of the preferred embodiments of the present engine.

It is also desirable for generating output shaft speed independent of the orbital shaft speed. The orbital shaft speed will want to vary with the power load demanded by a current application of a variable motor or generator. The output shaft speed is likely to be controlled by the application; for example, generator speed, or drive speed of a vehicle. By disconnecting the orbital shaft speed from the output shaft speed, greater flexibility in the design and application of the system is available. The same engine with little or no modifications to the closed loop system could be used for vehicle transport, electrical generations, hydraulic power or various other applications.

As described above, one embodiment of the present invention is to directly convert orbital shaft rotation to work out through a direct power pick off. Power pick-off of the orbital shaft has the limitation described several limitations described, primarily; inefficiencies associated with friction loss, moving parts requiring significant engineering and machining, larger penetrations of the engine assembly, and reduced integrity of the closed loop. This mode of operation is schematically shown on FIG. 1 by the block component 80. The prior art is replete with technologies for converting rotating shaft speed into rotating shaft speed of vehicles, generators, pumps and the like. This mode is generally not preferred when the goal is to create a small lightweight high power density engine.

Another mode of operation for the engine is to use the high pressure output of the variable displacement pumps in a refrigeration cycle and returning warmed up expanded working fluid from said refrigeration cycle. This mode of operation is depicted in FIG. 1 by the block 90. It should be noted that the output of the variable displacement pumps is directed to the refrigeration loop and the return line for the working fluid is connected to the output of the regenerative heat exchanger for the exhaust fluid. Operation of a refrigeration loop can be done in conjunction with the power conversion of the high pressure working fluid in a variable displacement motor or generator.

Another embodiment of the engine uses a power control valve 51 located on the outlet of the variable displacement pumps 31 and 41. It should be noted that the orbital shaft could have one or more variable displacement pumps attached to the orbital shaft and the number and size of the variable displacement pumps depends upon the desired pump output. In the schematic shown, FIG. 1, a configuration with two variable displacement pumps 31 and 41 pressurizing the working fluid prior to reheating in the regenerative heat exchanger 52. The pumps, preferably swash plate variable displacement liquid pumps, are designed to produce a constant high pressure output despite load requirements from the one or more power outputs of the system. The pumps respond to a mass flow demand on the high-pressure side of the engine, as shown as point E of FIG. 2. The speed of the scroll expanders are controlled by the mass flow of the working fluid delivered to the scroll expanders, via the evaporator, by a power control valve 51. In this way the scroll expanders always operate near their optimal pressure and efficiency.

The power output of the engine varies with the speed of the scroll expanders which is controlled by the power control valve 51 and the level of heat being supplied to the evaporator 60. Not only are swash plate variable displacement pumps used in the preferred embodiment because they are efficient and reliable, they are designed to always deliver the constant output pressure regardless of the demand on the system. They will automatically adjust their displacement as required to maintain this output pressure regardless of the speed of the orbital shaft 91 or feed pressure of the working fluid supplied by the working fluid reservoir 23.

The engine depicted in FIG. 1 is not limited to cycles in which the working fluid undergoes phase change prior to pressurizing as shown in FIG. 2*a*. The engine of the preferred embodiment is capable of operating in various thermodynamic modes, including; a Brayton cycle engine when the engine's operating environment raises the temperature on a heat sink side of the condenser preventing conversion of the working fluid to liquid phase. In a Brayton cycle mode of operation, see FIG. 2*b*, expansion of the working fluid through the one or more scroll expanders is depicted from point A to point B. The exhaust working fluid supplies heat to the working fluid prior to the working fluid entering the evaporator 60—the regenerator 52 depicted, by point B to point C for the exhaust and point E to point F for the preheating of the working fluid. Whatever cooling is accomplished by the condenser will take the working fluid from point C to point D—in the Brayton cycle the working fluid does not undergo phase change and the working fluid while more dense is still in a gaseous phase. The pumping of the low temperature working fluid into the evaporator will be less, efficient when the working fluid is in a gaseous or vapor phase, point D to point E, however the efficiency of utilizing an external heat source makes up for some of the inefficiencies associated with a lack of phase change prior to pressurization of the working fluid. Condensing the working fluid to a liquid is mostly a function of the environment in which the engine is operating or the type of condenser used in the closed loop.

Other modes of operation for the engine exist as well, including operation of the engine with the working fluid remaining above critical pressure throughout the closed loop cycle, as depicted in FIG. 2*c*. After working fluid exits the evaporator 60 as depicted as point A FIG. 2*c*, the one or more scroll expanders reduces the temperature and pressure of the working fluid to point B. The regenerator 52 converts the high temperature exhaust point B to a lower temperature and pressure point C. High pressure working fluid headed toward the evaporator absorbs the latent heat of the exhaust—depicted as point E to point F. When the working fluid is passed through the condenser 95, point C to point D, the working fluid undergoes a phase change to a supercritical liquid. The pump pressurizes the working fluid, point D to point E. The pressure of the working fluid throughout the system is above critical pressure allowing for the most efficient means for operating the engine as described in U.S. Pat. No. 3,237,403.

Another feature of the present invention is the ability to use a variety of fuels or heat sources for raising the temperature of the working fluid prior to expansion. In one embodiment of the invention, the heat source is provided by the combustion of carbon fuels. In another embodiment of the engine, the heat source is provided by heated materials capable of retaining their energy over a significant period of time while supplying a high temperature heat source. Heated bricks or containers of molten salts or molten metal like Lithium, or Aluminum or mixtures or Lithium and Lithium hydride are possible. Other heat sources including solar collectors, geothermal, and electrical power sources are readily available with little or no alterations to the closed loop system.

It should be pointed out that the figures and description for the scroll expanders shows first and second scroll expander with the working fluid being processed by the expander in sequential order. Another embodiment of this engine include, two or more scroll expanders arranged such that the working fluid is processed in parallel instead of in sequence as depicted in FIG. 1. Other scroll expander arrangements are not shown but it is the intent of the present invention to capture the use of at least one scroll expander in an external combustion closed loop system with the scroll expander work being used to pressurize the working fluid. In addition, the work output of the scroll expanders will be captured by use of at least one variable displacement pumps that are able to transfer mechanical energy into hydraulic or fluid energy for a variety of energy outputs.

I claim:

1. An engine to convert heat into mechanical output using a working fluid in a closed-circulating system, the engine comprising:

a variable displacement pump configured to raise a fluid pressure of the working fluid from a first pressure to a second pressure;

a heat receiving portion of a regenerative heat exchanger configured to receive the working fluid from the variable displacement pump, the regenerative heat exchanger configured to add heat to the working fluid;

a heating device configured to supply additional heat to the working fluid to raise a fluid temperature of the working fluid to a desired working temperature that is above a critical temperature of the working fluid;

a scroll expander having an inlet coupled to the heating device and an outlet, the scroll expander configured to generate the mechanical output through the expansion of the working fluid from the inlet to the outlet of the scroll expander;

a heat transmitting portion of said regenerative heat exchanger configured to receive the expanded working fluid from the outlet of the scroll expander and pass it therethrough;

a condenser coupled between an outlet of the heat transmitting portion and the variable displacement pump to reduce the fluid temperature to a low-cycle temperature; and a power control valve to adjust the mechanical output of the engine by adjusting a mass flow of the working fluid in the closed circulating system;

wherein the variable displacement pump is configured to compensate for the adjustment of the mass flow rate by maintaining the second pressure in a specified range.

2. The engine of claim 1 wherein:

the variable displacement pump is configured to raise the fluid pressure of the working fluid in a liquid phase from the first pressure to the second pressure, wherein the second pressure is a supercritical pressure;

the heating device is configured to supply additional heat to the working fluid to raise the fluid temperature to a desired working temperature substantially above the critical temperature;

the heat receiving portion of the regenerative heat exchanger or the heating device is configured to transform the fluid from a liquid phase to a gaseous phase;

the condenser is configured to reduce the fluid temperature to a temperature substantially below its critical temperature prior to the working fluid being returned to the variable displacement pump; and the heat transmitting portion of said regenerative heat exchanger or the condenser is configured to transform the working fluid from a gaseous phase to a liquid phase.

3. The engine of claim 1, wherein the first pressure is substantially above the critical pressure of the working fluid and the low-cycle temperature is below the critical temperature of the working fluid.

4. The engine of claim 1 wherein the first pressure is above critical pressure and the low-cycle temperature is at or above the critical temperature of the working fluid.

5. The engine of claim 1, further comprising:

an engine block including the scroll expander;

wherein the heating device is external to the engine block.

6. The engine of claim 1, further comprising:

an orbital shaft coupled to the scroll expander and configured to drive both the variable displacement pump and a direct-shaft power pick off.

7. The engine of claim 1, wherein the working fluid is carbon dioxide.

8. The engine of claim 1, wherein the variable displacement pump is adapted to be driven at least in part by the mechanical output generated by the scroll expander.

9. A method of converting heat into mechanical output using a working fluid in a closed-circulating system, comprising:

supplying a working fluid at a low-cycle temperature;

raising a fluid pressure of the working fluid with a variable displacement pump from a first pressure to a second pressure;

adding heat to the working fluid at substantially its second pressure to raise a fluid temperature of the working fluid to a high-cycle temperature above a critical temperature of the working fluid;

expanding the working fluid through a scroll expander to generate the mechanical output and reduce the fluid pressure;

cooling the working fluid to reduce the fluid temperature substantially down to a low-cycle temperature;

transferring heat contained in an expanded portion of the working fluid to a pressurized portion of the working fluid using a regenerative heat exchanger during the cooling of the working fluid;

controlling the mechanical output of the engine by regulating a mass flow rate of the working fluid; and compensating, by the variable displacement pump, for adjustments to the mass flow rate of the working fluid to maintain the second pressure in a specified range.

10. The method of claim 9, further comprising:

cooling the working fluid at said first pressure to reduce the fluid temperature to a temperature substantially below its critical temperature to render it completely liquid prior to raising the fluid pressure of the working fluid.

11. The method of claim 9, further comprising:

maintaining the first pressure substantially above the critical pressure and reducing the low-cycle temperature below the critical temperature.

12. The method of claim 9, further comprising:

maintaining the working fluid at the low-cycle temperature at or above the critical temperature, wherein the fluid pressure is above critical pressure throughout the system.

13. The method of claim 9, wherein the variable displacement pump is adapted to be driven at least in part by the mechanical output generated by the scroll expander.

14. The method of claim 9, further comprising:

raising a fluid pressure of a secondary working fluid in a secondary closed circulating system by using a hydraulic pump from a third pressure to a fourth pressure;

rotating a pump shaft of the hydraulic pump from the mechanical output generated by the scroll expander;

generating a second mechanical output by expansion of the secondary working fluid from an inlet to an outlet of a hydraulic motor; and returning the secondary working fluid back to the hydraulic pump at the first pressure.

15. The method of claim 9, further comprising:

rotating an orbital shaft with the scroll expander to drive the variable displacement pump and a direct shaft power take off.

* * * * *